US005641740A

United States Patent [19]

Debska-Chwaja

[11] Patent Number: 5,641,740

[45] Date of Patent: Jun. 24, 1997

[54] LUBRICATING OIL HAVING LUBRICATION CONDITION RESPONSIVE ACTIVITY

[75] Inventor: Anna Debska-Chwaja, Suffern, N.Y.

[73] Assignee: Witco Corporation, Greenwich, Conn.

[21] Appl. No.: 561,147

[22] Filed: Nov. 21, 1995

Related U.S. Application Data

[63] Continuation of Ser. No. 265,240, Jun. 24, 1994, abandoned.

[51] Int. Cl.[6] ..... C10M 129/74

[52] U.S. Cl. ..... 508/488; 508/486

[58] Field of Search ..... 508/486, 488; 252/56 R

[56] References Cited

U.S. PATENT DOCUMENTS

| | | | |
|---|---|---|---|
| 2,119,718 | 6/1938 | Pevere | 508/486 |
| 2,138,771 | 11/1938 | Pevere | 508/308 |
| 2,158,096 | 5/1939 | Werntz | 508/480 |
| 2,204,597 | 6/1940 | Humphreys | 508/498 |
| 2,204,601 | 6/1940 | Kavanagh | 508/497 |
| 2,296,342 | 9/1942 | Gaylor | 508/496 |
| 2,443,578 | 6/1948 | Fuller | 58/497 |
| 2,443,579 | 6/1948 | Fuller | 508/497 |
| 2,531,801 | 11/1950 | Blake | 508/492 |
| 2,647,920 | 8/1953 | Patrick | 508/466 |
| 2,898,299 | 8/1959 | Lowe | 508/308 |
| 2,972,579 | 2/1961 | Delfel | 508/215 |
| 3,235,499 | 2/1966 | Waldmann | 508/214 |
| 3,429,815 | 2/1969 | Drake | 508/488 |
| 3,816,311 | 8/1974 | Malec | 508/267 |
| 3,862,048 | 1/1975 | Sheratte | 252/785 |
| 3,970,570 | 7/1976 | Pratt | 508/214 |
| 4,336,149 | 6/1982 | Erdman | 508/501 |
| 4,505,829 | 3/1985 | Wisotsky | 508/291 |
| 4,517,105 | 5/1985 | Laemmle | 252/56 R |
| 4,634,469 | 1/1987 | Laemmle et al. | 106/38.24 |
| 4,683,069 | 7/1987 | Brewster et al. | 252/56 R |
| 4,775,418 | 10/1988 | Laemmle et al. | 106/38.24 |
| 4,783,274 | 11/1988 | Jokinen et al. | 252/56 R |
| 5,034,144 | 7/1991 | Ohgake et al. | 252/56 R |
| 5,064,546 | 11/1991 | Dasai | 252/56 R |
| 5,114,603 | 5/1992 | Kennedy et al. | 252/56 R |
| 5,145,593 | 9/1992 | Takashima | 252/56 R |
| 5,156,759 | 10/1992 | Culpon, Jr. | 252/56 R |

FOREIGN PATENT DOCUMENTS

| | | |
|---|---|---|
| 1338505 | 11/1973 | United Kingdom . |
| 1340804 | 12/1973 | United Kingdom . |

OTHER PUBLICATIONS

E.N. Marcheva;"Production of white compressor oilNKM–40 from Western Siberian petroleums"; 1984;101: 75489d.

V.A. Potanina;"NKM–40 naphthenic compressor oil used in the production of polyethylene";1978;88: 155412b.

Smalheer et al, "Lubricant Additives", pp. 1–11, 1967.

*Primary Examiner*—Ellen M. McAvoy

*Attorney, Agent, or Firm*—Scully, Scott, Murphy & Presser

[57] ABSTRACT

An oil particularly suited for equipment having copper containing alloy elements, is compounded from about 20 to 99.75% by weight of natural or synthetic oil, and about 0.25 to 30% by weight of an acid forming friction modifier, particularly, a fully esterified compound, such as glycerol trioleate (GTO). The oil evidences a marked improvement in frictional behavior and wear protection, especially regarding the corrosive wear of Cu based alloys. The oil containing glycerol trioleate does not release oleic acid unless and until boundary conditions are present, thereby on one hand effectively lubricating under boundary conditions, while on the other hand minimizing the presence of oleic acid and thereby reducing chemical wear.

22 Claims, 1 Drawing Sheet

LUBRICATING OIL HAVING LUBRICATION CONDITION RESPONSIVE ACTIVITY

This is a continuation of application Ser. No. 08/265,240 filed on Jun. 24, 1994 abandoned.

BACKGROUND OF THE INVENTION

1. Field of the Invention

This invention relates to lubricating oils. More specifically, this invention relates to protective oils for equipment with copper alloy components as in polyethylene compressors.

2. Discussion of the Prior Art

Heretofore it was well known in the lubricating art to provide white mineral oil lubricants for compressors, as is disclosed in W. A. Potanina, E. N. Marcheva, E. N. Sidlyaronok, S. K. Bogdanov, T. P. Ponomareva "NKM-40 naphthenic compressor oil used in the production of polyethylene". Khim. Technol. Topliv Masel, No. 1 (1978) 22–23; and E. N. Marcheva, W. A. Potanina, G. T. Fuks, "Production of NKM-40 White Oil Compressor Lubricant From the West Siberian Crudes" Khim. Technol. Topliv Masel, No. 7 (1984) 11–12.

It was also known in the prior art to provide amounts of oleic acid in white mineral oil as friction modifier, such as disclosed in British Patent No. 1,338,505. The continued presence of oleic acid in the blends used for copper based alloy parts lubrication caused unnecessary chemical wear. That is, oleic acid provided good lubricity, but its continual presence caused unnecessary chemical wear because of its ongoing reactivity with the copper-containing alloy.

Other lubricating compositions used certain phosphates and oleates as anti-wear additives, such as disclosed in U.S. Pat. No. 3,970,570 to Pratt, et al.

Wisotsky, U.S. Pat. No. 4,505,829 discloses the use of glycerol monoleate and glyceroi dioleate as stabilizing additives for the lubricating oil. Waldmann, U.S. Pat. No. 3,235,449 also discloses the use of partial esters of glycerols for foam stabilization in lubricants.

British Patent No. 1,340,804 discloses a lubricating composition for a two-stroke internal combustion engine. That composition includes the synergistic combination of a polybutene or polyisobutylene with a triglyceride of an unsaturated aliphatic carboxylic acid containing 18 carbon atoms, with the triglyceride to polymer ratio being 1:10 to 1:30.

Culpon, U.S. Pat. No. 5,156,759 discloses the use of di and tri synthetic polyol esters as solubilizers for other additives in polyalphaolefin base oil.

In the art relating to the lubrication of equipment with copper bearing alloy surfaces, there was the specific problem of chemical wear caused by the oleic acid friction modifier. The art therefore desired an oil that not only improved frictional characteristics but exhibited a high level of protection against copper base alloy chemical wear.

SUMMARY OF THE INVENTION

Figure 1:
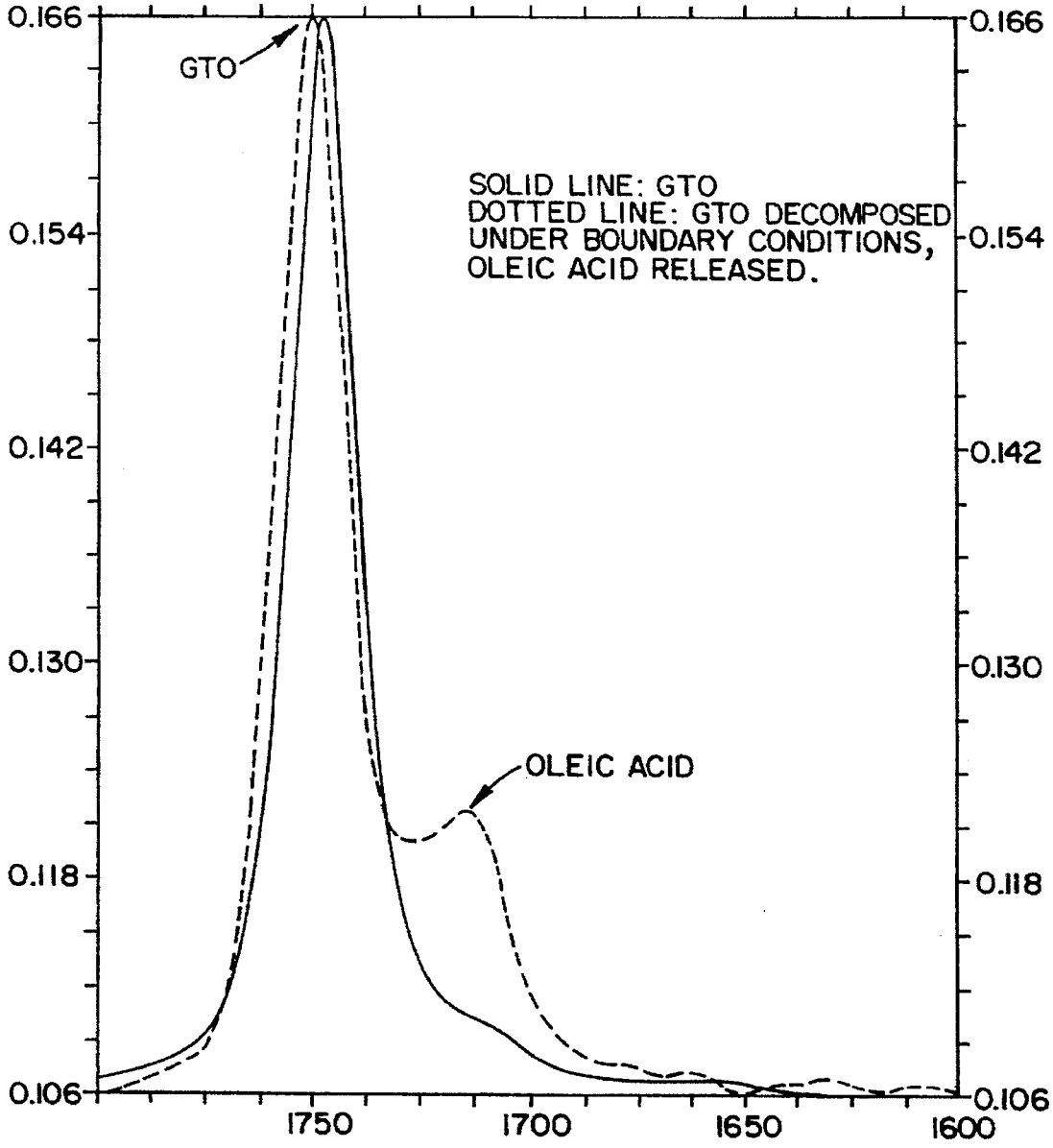
FIG. 1 is a graph of the FTIR spectrum showing absorbance vs. wavenumber ($cm^{-1}$) for 3% GTO in mineral oil in the initial blend (solid line) and under boundary conditions (dotted line), with the secondary peak on the dotted line representative of the presence of oleic acid.

The invention may broadly be considered as an oil with a friction modifier which exhibits excellent lubricating properties without causing chemical wear of copper bearing alloy parts under hydrodynamic and quasihydrodynamic conditions.

The invention may also be expressed as a copper based alloy lubricating oil, which includes a natural or synthetic oil with a friction modifier which is not reactive with the said alloy except under special conditions of temperature and pressure.

A fully esterified organic compound, such as glycerol trioleate (GTO), in amounts of 0.25 to 30% by weight, and preferably 0.5 to 10% by weight is a most effective friction modifier which is not reactive with the Cu based alloys.

It has now been found that glycerol trioleate improves the frictional and antiwear properties of the compressor oil blend, by not chemically reacting with the Cu based alloy, which under hydrodynamic lubrication conditions is not necessary. Furthermore, under boundary conditions, where the chemical attack is needed, it was unexpectedly found that glycerol trioleate decomposes releasing oleic acid (see FTIR spectrum in FIG. 1). Released oleic acid reacts with the metal surface and creates metal soaps with desirable shear properties and melting points, thereby assuring lubrication in boundary situations.

That is why it is advantageous that the blend contains glycerol trioleate which will give excellent protection in hydrodynamic and quasihydrodynamic conditions without chemically reacting with a copper base alloy, and in the case of need (i.e. when flash temperatures develop in boundary situations) will release oleic acid, which in turn provides protection due to its reactivity with the metal surface.

It is an object of the present invention to provide an oil which does not chemically react with a copper alloy under hydrodynamic conditions.

It is a further object of the present invention to provide an oil as aforesaid which exhibits improved wear protection.

It is still a further object of the present invention to provide an oil with improved lubricity and significantly better corrosive wear protection.

It is another object of the present invention to provide an oil as aforesaid in combination with equipment having copper based alloy parts.

It is still a further object of the present invention to provide a method for lubricating a copper base alloy surface.

It is another object of the present invention to provide a method as aforesaid which gives improved lubricity under boundary conditions.

DETAILED DESCRIPTION OF THE INVENTION

In one aspect, the present invention is a lubricating oil which includes a friction modifier which friction modifier does not chemically react with the copper based alloy under hydrodynamic or quasihydrodynamic conditions, but becomes reactive under boundary conditions, and ensures the presence of lubrication during the boundary conditions. That is, the activity of the oil is specifically responsive to the specific lubrication conditions.

The terms "copper based alloy" or "copper alloy" as used herein shall mean any alloy which includes copper, including without limitation, bronze, brass, admiralty metal, muntz metal and the like.

In one other aspect, the present invention is a natural or synthetic lubricating oil with improved lubricity characteristics and a high degree of wear protection. In still another aspect, the present invention is a copper based alloy lubricating oil having about 20 to 99.75% by weight of a mineral or synthetic oil and 0.25 to 30%, and preferably 0.5 to 10% by weight, of a friction modifier which provides the previously mentioned high level of copper alloy corrosive wear protection.

The oil composition of the present invention may additionally contain viscosity builders, detergents, dispersants, anti-oxidants, EP additives and anticorrosive additives, as will be fully discussed hereafter.

One preferred specific configuration of the present invention is as follows:

| | |
|---|---|
| mineral oil | 96.8% |
| glycerol trioleate | 3.0% |
| phosphate ester (EP additive) | 0.1% |
| phenolic antioxidant | 0.1% |

The friction modifiers useful in the present invention are those that produce acid under lubrication boundary conditions. It has been found that fully esterified compounds, such as glycerol trioleate (GTO), when subjected to boundary conditions will release oleic acid, and that this in situ formation of oleic acid is quite effective in providing the requisite lubrication.

Importantly, the glycerol trioleate is not only readily and fully miscible with the base oil, but the blend is also stable during storage unlike the partial esters, mono- and dioleates, which separate on standing, and are, therefore, not operable.

Glycerol trioleate (GTO) in oil provides an operable lubricating oil under a wide range of in service conditions, including hydrodynamic, quasihydrodynamic and boundary conditions. While GTO is the preferred friction modifier, other fully esterified triols or higher polyols are within the contemplation of the invention. The acid moiety may be oleic, linoleic, stearic, palmitic, erucic, salicylic, boric and the like.

Suitable base oils useful in the present invention include all natural and synthetic oils. Preferred oils are the mineral oils, in particular paraffinic and naphthenic oils. Most preferred for the food grade lubricants are the white mineral oils. The white mineral oils employed in the compositions of the invention may be of the kind derived by conventional refining techniques from crude sources such as paraffinic crudes, naphthenic crudes or mixed base crudes and are conveniently employed in an amount of from 20 to 99.75% by weight of the compositions. Suitable white mineral oils are those of a high quality grade, as indicated by having an unsulphonatable residue (ASTM D-483-63) of at least 95%. Preferably the white mineral oils employed are of the kind having an unsulphonatable residue on the order of from 99% to 100%. The white oils used in the compositions according to the invention should preferably exhibit good color and should generally be fully refined white mineral oils. Such oils are, for example, those having a water white color of +30 Saybolt and in addition, are preferably essentially free of carbonizable substances and exhibit low absorption of ultraviolet light in the wave lengths of 2750, 2950 and 3000 Angstroms (ASTM D-2008). The viscosity of the white mineral oils which may be employed in the lubricating compositions of the present invention is in the range of from 40 to 2000 S.U.S at 100° F. and preferably 70 to 500 S.U.S.

It is also within the contemplation of the present invention to provide polymeric viscosity builders, such as polybutenes, polymethacrylates, polyacrylics, polyethylenes and polyvinyl acetates. The polymers employed in the compositions according to the invention serve as both viscosity builders and viscosity index improvers, and are preferably employed in amounts of from 5 to 50% by weight of the composition. Suitable polymers include those preferably having a molecular weight of between 300 and 100,000. The polymers employed in the compositions of the present invention are those which are miscible with the oil. Where white oil is the base oil, a polybutene is the preferred polymer.

A broad range of antioxidants may be used in the present invention, such as by way of example, sulfides, disulfides, sulfoxides, phosphites, amines, thiophosphates and phenolics, including vitamin E.

The antioxidants which are employed in the lubricating composition of the invention are preferably present in amounts of from 0.01% to 1.5% by weight of the composition. Phenolic antioxidants are preferred in the case of food grade lubricants. Examples of the invention include 4-methyl-2, 6-di-t-butylphenol; 2,4-di-t-butylphenol; and 2,4,6-tri-tertiarybutylphenol. Preferred antioxidants are orthotertiary alkyl substituted phenols, such as 4-methyl-2, 6-di-t-butyl-phenol.

It is also within the contemplation of this invention to provide very limited amounts of detergents in combination with the fully esterified acid releasing friction modifiers. The detergents if present comprise typically amounts of 0.5 to 1.5% by weight.

Suitable detergents include the fatty acids and their soaps, sulfonates, phosphates and thiophosphonates, and alkyl substituted salicylates.

It is also within the contemplation of this invention to provide a lubricant containing extreme pressure (EP) additives. A broad range of EP additives are within the contemplation of the invention. The preferred EP additives include the phosphates such as the triaryl phosphates. The amount of any particular EP additive that should be present for effective results can readily be determined.

It is also within the contemplation of the present invention to incorporate small amounts of a dispersant, such as by way of example amine salts of high molecular weight organic acids such as petroleum sulfonic acids, organo phosphorus acids and mixtures thereof. The dispersant need only be present in effective amounts of about 1.5 weight %.

EXAMPLES

The following blends were prepared using conventional blending techniques:

| Blend | Composition (wt. %) |
|---|---|
| I | 100% mineral oil |
| II | 87.2% mineral oil |
| | 3.0% oleic acid |
| | 9.7% polymeric viscosity builder |
| | 0.1% phenolic antioxidant |
| III | 99.5% mineral oil |
| | 0.5% glycerol trioleate |
| IV | 97% mineral oil |
| | 3% glycerol trioleate |
| V | 96.8% mineral oil |
| | 3% glycerol trioleate |
| | 0.1% EP Additive |
| | 0.1% phenolic antioxidant |

Blends I and II are typical prior art composition.

Blends III–V are compositions within the contemplation of the present invention.

Blends I–V were subjected to the Roxanna Four Ball Test (1 tungsten carbide ball and 3 bronze discs) under various loads of 5 kg to 180 kg at 250° F. at 600 rpm for 30 minutes, and the results of the scar diameter measurements are reported in Table I.

Blend IV and certain control blends were subjected to the previously described Roxanna Four Ball Test and the scar diameter results measured are reported in Table II.

The average coefficient of friction for each of Blends I–V was calculated based on the frictional force measurements during the Four Ball Test runs (conditions as above) and is reported in Table III.

TABLE I

Wear Protection given by Blends I–V (4 Ball Test Data)

| Load (kg) | Scar Diam. (mm) | Composition (wt. %) |
|---|---|---|
| Blend I | | |
| 5 | 1.50 | 100% mineral oil |
| 10 | 1.60 | |
| 20 | 1.65 | |
| 40 | 1.70 | |
| 60 | 1.80 | |
| 120 | 1.90 | |
| 180 | 2.00 | |
| Blend II | | |
| 5 | 0.75 | 87.2% mineral oil |
| 10 | 0.85 | 3.0% oleic acid |
| 20 | 1.05 | 9.7% polymeric viscosity builder |
| 40 | 1.30 | 0.1% phenolic antioxidant |
| 60 | 1.55 | |
| 120 | 1.95 | |
| 180 | 2.10 | |
| Blend III | | |
| 5 | 0.65 | 99.5% mineral oil |
| 10 | 0.75 | 0.5% glycerol trioleate |
| 20 | 0.88 | |
| 40 | 1.00 | |
| 60 | 1.20 | |
| 120 | 1.40 | |
| 180 | 1.73 | |
| Blend IV | | |
| 5 | 0.55 | 97% mineral oil |
| 10 | 0.65 | 3% glycerol trioleate |
| 20 | 0.75 | |
| 40 | 0.95 | |
| 60 | 1.25 | |
| 120 | 1.55 | |
| 180 | 1.78 | |
| Blend V | | |
| 5 | 0.55 | 96.8% mineral oil |
| 10 | 0.65 | 3% glycerol trioleate |
| 20 | 0.75 | 0.1% EP Additive |
| 40 | 0.90 | 0.1% phenolic |
| 60 | 1.10 | antioxidant |
| 120 | 1.35 | |
| 180 | 1.73 | |

TABLE II

Influence of Different Additives on Wear Protection (4 Ball Test Data)

| Load (kg) | Scar Diam. (mm) | Composition (wt. %) |
|---|---|---|
| 5 | 0.65 | 97% mineral oil |
| 10 | 0.70 | 3% oleic acid |
| 20 | 1.10 | |
| 40 | 1.30 | |
| 60 | 1.60 | |
| 120 | 1.80 | |

TABLE II-continued

Influence of Different Additives on Wear Protection (4 Ball Test Data)

| Load (kg) | Scar Diam. (mm) | Composition (wt. %) |
|---|---|---|
| 180 | 2.10 | |
| 5 | 0.70 | 97% mineral oil |
| 10 | 0.80 | 3.0% mono and di glycerides |
| 20 | 1.00 | |
| 40 | 1.10 | |
| 60 | 1.35 | |
| 120 | 1.75 | |
| 180 | 2.10 | |
| 5 | 0.55 | 97% mineral oil |
| 10 | 0.65 | 3% glycerol trioleate (Blend IV) |
| 20 | 0.75 | |
| 40 | 0.95 | |
| 60 | 1.25 | |
| 120 | 1.55 | |
| 180 | 1.78 | |

TABLE III

Frictional Properties of Blends I–V (4 Ball Test Data) Measured for the Load Range 5–180 kg

| | Average Coeff. of Friction | Composition (wt. %) |
|---|---|---|
| Blend I | 0.0850 | 100% mineral oil |
| Blend II | 0.0750 | 87.2% mineral oil<br>3.0% oleic acid<br>9.7% polymeric<br>0.1% phenolic antioxidant |
| Blend III | 0.0470 | 99.5% mineral oil<br>0.5% glycerol trioleate |
| Blend IV | 0.370 | 97% mineral oil<br>3% glycerol trioleate |
| Blend V | 0.0290 | 96.8% mineral oil<br>3% glycerol trioleate<br>0.1% EP additive<br>0.1% phenolic antioxidant |

Table I demonstrates the substantial improvement in wear protection by employing glycerol trioleate as the friction modifier. In this regard particularly compare the results of Blend III with those of Blends I and II, and the dramatic reduction in scar diameter as a result of the presence of only 0.5% glycerol trioleate.

Table II demonstrates the improved wear protection given by the additive, glycerol trioleate, a fully esterified compound, when compared with the partial esters and with oleic acid.

Table III demonstrates a significant decrease in the coefficient of friction with the addition of only 0.5% GTO (compare Blends I and III).

There has been shown a lubricating oil which gives improved wear protection.

A broad range of applications are useful in the present invention. One preferred application is the use of the oil as a lubricant for polyethylene compressors. In this specific application, white oil is the preferred based oil, and the use of the GTO with limited amounts of oleic acid is also contemplated.

Other applications of the present lubricating oil will be apparent to those skilled in the art.

What is claimed is:

1. A lubricating oil composition which is effective to impart improved frictional and antiwear properties under hydrodynamic, quasihydrodynamic and boundary conditions and having lubrication condition responsive activity, comprising a mineral or synthetic oil and 0.25 to 30% by weight of an oil soluble triol ester friction modifier wherein the friction modifier is not chemically reactive with a copper based metal surface under hydrodynamic or quasihydrodynamic conditions but is reactive with the copper based metal surface under boundary conditions.

2. The oil of claim 1, wherein said friction modifier is a fully esterified compound.

3. The oil of claim 2, wherein said friction modifier is glycerol trioleate.

4. The oil of claim 3, wherein said oil is present in an amount of 20 to 99.5% by weight.

5. The oil of claim 4, further comprising a viscosity builder.

6. The oil of claim 5, further comprising an EP additive.

7. The oil of claim 6, further comprising an antioxidant.

8. The oil of claim 3, wherein said glycerol trioleate is present in an amount of about 0.5 to 10% by weight.

9. The oil of claim 8, further comprising about 0.5 to 1.5% by weight of oleic acid.

10. In combination;

a copper alloy metal lubrication surface which may be subject to boundary conditions; and, in physical contact with said surface, a lubricating oil composition which is effective to impart improved frictional and antiwear properties under hydrodynamic, quasihydrodynamic and boundary conditions and comprising a mineral oil and 0.25 to 30% by weight of an oil soluble triol ester friction modifier in said oil, which is not reactive with the copper alloy metal surface except under the boundary conditions.

11. The combination of claim 10, wherein said mineral oil comprises a white oil.

12. The combination of claim 10, wherein said friction modifier comprises a fully esterified compound.

13. The combination of claim 12, wherein said friction modifier comprises glycerol trioleate.

14. The combination of claim 13, further comprising a polymeric viscosity builder.

15. The combination of claim 14, further comprising a phenolic antioxidant.

16. The combination of claim 15, further comprising an EP additive.

17. The combination of claim 10, wherein said oil comprises:

mineral oil in about 96%;

glycerol trioleate in about 3%;

EP additive in about 0.1%; and an antioxidant in about 0.1%, by weight.

18. A method of lubricating a copper alloy surface, wherein said surface is being subjected to hydrodynamic, quasihydrodynamic or boundary conditions, comprising:

lubricating said surface with an oil composition which is effective to impart improved frictional and antiwear properties under said hydrodynamic, quasihydrodynamic and boundary conditions, said oil comprising a mineral or synthetic oil and 0.25 to 30% by weight of an oil soluble triol ester friction modifier;

wherein said oil does not attack the alloy under hydrodynamic or quasihydrodynamic conditions but effects an attack on the alloy under boundary conditions.

19. The method of claim 18, wherein the oil comprises a mineral oil.

20. The method of claim 19, wherein the friction modifier comprises glycerol trioleate.

21. The method of claim 20, wherein the mineral oil is present in an amount of about 20 to 99.75% by weight.

22. The method of claim 21, further comprising adding about 0.5 to 1.5% oleic acid to said oil.

* * * * *